US010027015B2

(12) United States Patent
Kim et al.

(10) Patent No.: US 10,027,015 B2
(45) Date of Patent: Jul. 17, 2018

(54) ANTENNA DEVICE

(71) Applicant: Samsung Electronics Co., Ltd., Suwon-si (KR)

(72) Inventors: Yoon-Geon Kim, Busan (KR); Seung-Tae Ko, Bucheon-si (KR); Sang-Ho Lim, Suwon-si (KR); Won-Bin Hong, Seoul (KR)

(73) Assignee: Samsung Electronics Co., Ltd. (KR)

( * ) Notice: Subject to any disclaimer, the term of this patent is extended or adjusted under 35 U.S.C. 154(b) by 233 days.

(21) Appl. No.: 14/932,682

(22) Filed: Nov. 4, 2015

(65) Prior Publication Data

US 2016/0134008 A1 May 12, 2016

(30) Foreign Application Priority Data

Nov. 7, 2014 (KR) ..... 10-2014-0154384

(51) Int. Cl.
*H01Q 1/12* (2006.01)
*H01Q 1/38* (2006.01)
*H01Q 21/28* (2006.01)

(52) U.S. Cl.
CPC ..... *H01Q 1/1271* (2013.01); *H01Q 1/38* (2013.01); *H01Q 21/28* (2013.01)

(58) Field of Classification Search
CPC ..... H01Q 1/1271
USPC ..... 343/711
See application file for complete search history.

(56) References Cited

U.S. PATENT DOCUMENTS 6,031,500 A 2/2000 Nagy et al.
6,307,516 B1 * 10/2001 Zafar ..... H01Q 1/1278 343/704
7,129,444 B2 10/2006 Weiss
8,426,776 B2 4/2013 Wang et al.
2003/0197650 A1 10/2003 Walton et al.
2005/0057420 A1 3/2005 Lin et al.
2006/0196865 A1 9/2006 Weiss
2008/0274652 A1 11/2008 Li et al.
(Continued)

OTHER PUBLICATIONS

International Search Report dated Jan. 26, 2016 corresponding to International Application No. PCT/KR2015/010283.
(Continued)

*Primary Examiner* — Dameon E Levi
*Assistant Examiner* — Walter Davis
(74) *Attorney, Agent, or Firm* — McAndrews, Held & Malloy, Ltd.

(57) ABSTRACT

According to various embodiments of the present disclosure, an antenna device may include: a base substrate; a mesh grid formed by transparent electrodes on at least one surface of the base substrate; and a power feeding port connected to the mesh grid to provide a power feeding signal. At least a part of the mesh grid may form a radiation element with at least one of the power feeding signal indicative of direct feeding, and the power feeding signal indicative of coupled feeding indirectly. Since the radiation element may be configured by forming the mesh grid using a transparent conductive material, the antenna device may be easily concealed. Even if the antenna device is attached to, for example, a window glass of a vehicle or a window of a building, the antenna device may contribute to the removal of a shadow region while sufficiently securing the visibility of the glass.

20 Claims, 11 Drawing Sheets

(56) References Cited

U.S. PATENT DOCUMENTS

| | | | | |
|---|---|---|---|---|
| 2009/0002240 | A1* | 1/2009 | Sievenpiper | H01Q 9/30 343/700 MS |
| 2012/0162128 | A1* | 6/2012 | Hyoung | G06F 3/044 345/174 |
| 2013/0127672 | A1* | 5/2013 | Zhu | H01Q 7/00 343/702 |

OTHER PUBLICATIONS

Written Opinion of the International Searching Authority dated Jan. 26, 2016 corresponding to International Application No. PCT/KR2015/010283.

* cited by examiner

ANTENNA DEVICE

RELATED APPLICATION(S)

This application claims the priority under 35 U.S.C. § 119(a) to Korean Application Serial No. 10-2014-0154384, which was filed in the Korean Intellectual Property Office on Nov. 7, 2014, the entire content of which is hereby incorporated by reference.

BACKGROUND

Various embodiments of the present disclosure relate to an antenna device.

Recently, wireless communication techniques have been implemented by using various methods, such as Wireless Local Area Network (W-LAN) represented by Wi-Fi technique, Bluetooth, and near field communication (NFC), in addition to a commercial mobile communication network connection. Mobile communication services were initiated from a first generation mobile communication service centered on voice communication, and have gradually been developed to a super-high speed and large capacity service (e.g., a high quality video streaming service). It is expected that the next generation mobile communication service, which is to be commercially available in the future, will be provided through an ultra-high frequency band of dozens of GHz or more.

As communication standards, such as W-LAN or Bluetooth, are evolving, electronic devices, such as mobile communication terminals, are equipped with antenna devices to accommodate operation in various different frequency bands. For example, the $4^{th}$ generation mobile communication services are operated in a frequency band of, e.g., 700 MHz, 1.8 GHz, or 2.1 GHz. Wi-Fi is operated in a frequency band of 2.4 GHz or 5 GHz which may differ slightly depending on protocols, and Bluetooth is operated in a frequency band of 2.45 GHz.

In order to provide a stable service quality in a commercial wireless communication network, an antenna device should satisfy a high gain and a wide beam coverage. The next generation mobile communication service will be provided through an ultra-high frequency band of dozens of GHz or more (e.g., a frequency band in a range of about 30 GHz to 300 GHz and having a resonance frequency wave length in a range of about 1 mm to 10 mm). Such ultra-high frequency band may require a higher performance than that of the antennas used in former commercial mobile communication services.

In general, as the operation frequency band increases, the rectilinear advancing property of radio waves may be improved and a loss due to the transmission distance may increase. In addition, as the rectilinear advancing property of radio waves is high, the attenuation or reflection loss of a signal power by an obstacle (building or geographic feature) may increase. Accordingly, in a communication system using a high operation frequency, local shadow regions may appear all over a built-up area or an indoor space of, for example, a vehicle or a building. Even in the indoor space of the same building, radio wave environments may be greatly different from each other depending on divided spaces. Accordingly, the communication system, which uses a high operation frequency band, may require a technique for delivering radio waves to a shadow region.

SUMMARY

Thus, various embodiments of the present disclosure are to provide an antenna device capable of improving an indoor radio wave environment in a built-up area or an indoor space of, for example, a vehicle or a building.

In addition, various embodiments of the present disclosure are to provide an antenna device capable of sufficient visibility even though it is attached to a glass.

Further, various embodiments of the present disclosure are to provide an antenna device capable of executing a hot-wire function for removing frost and moisture by being attached to a glass.

Therefore, according to various embodiments of the present disclosure, an antenna device may include: a base substrate; a mesh grid formed by transparent electrodes on at least one surface of the base substrate, or within the base substrate; and a power feeding port connected to the mesh grid in order to provide a power feeding signal. At least a part of the mesh grid may form a radiation element with at least one of the power feeding signal indicative of direct feeding directly, and a power feeding signal indicative of coupled feeding indirectly.

Further, according to various embodiments of the present disclosure, an antenna device may include: a mesh grid formed on at least one surface of a vehicle window glass formed of a transparent conductive material; a power feeding port connected to the mesh grid so as to provide a power feeding signal; and a DC power port that applies DC power to the mesh grid. At least a part of the mesh grid may form a radiation element by being provided with a power feeding signal a radiation element, and at least a part of the mesh grid may form a heating element by receiving a DC power applied thereto.

According to various embodiments, the antenna device may further include a direct current (DC) power port that applies a DC power to the mesh grid. At least a part of the mesh grid may form a heating element by receiving a DC power applied thereto. A radiation element and the heating element may at least partially overlap each other on the mesh grid.

According to various embodiments, the antenna device may further include: a direct current (DC) power blocking unit disposed between the power feeding port and the mesh grid; and a radio frequency (RF) blocking unit disposed between the DC power port and the mesh grid.

According to various embodiment, the antenna device may further include: first segmental portions formed by cutting connection of the transparent electrodes along a vertical direction with respect to a flow direction of a power feeding signal provided through the power feeding port; and second segmental portions formed by cutting connection of the transparent electrodes along a horizontal direction with respect to a flow direction of the power feeding signal provided through the power feeding port. The radiation element may be formed in a region surrounded by the first segmental portions and the second segmental portions.

According to various embodiments, the mesh grid may be formed on each of both surfaces of the base substrate, and the power feeding port may provide the power feeding signal to the mesh grid on one surface of the base substrate. The antenna device may further include a DC power port that applies the DC power to the mesh grid formed on another surface of the base substrate.

According to various embodiments, the antenna device may further include: a DC power blocking unit disposed between the power feeding port and the mesh grid; and a radio frequency (RF) blocking unit disposed between the DC power port and the mesh grid.

According to various embodiments, the antenna device may further include: first segmental portions formed by cutting connection of the transparent electrodes along a vertical direction with respect to a flow direction of a power feeding signal provided through the power feeding port; and second segmental portions formed by cutting connection of the transparent electrodes along a horizontal direction with respect to a flow direction of the power feeding signal provided through the power feeding port. The radiation element may be formed in a region surrounded by the first segmental portions and the second segmental portions.

According to various embodiments, the antenna device may further include a DC power port applying the DC power to the mesh grid between the first segmental portions or between the second segmental portions. The mesh grid between the first segmental portions or between the second segmental portions may form the heating element by receiving the DC power applied thereto.

According to various embodiments, the antenna device may include a plurality of radiation elements that are arranged along an edge of the window glass. Some of the plurality of radiation elements may provide a reception function, and remaining radiation elements may provide a transmission function.

Further, according to various embodiments of the present disclosure, an antenna device may include: a mesh grid formed from a transparent conductive material on one surface of a vehicle window glass; and a radiation element mounted on another surface of the window glass. The mesh grid may form a ground that provides a reference potential to the radiation element.

According to various embodiments, the radiation element may include a shark antenna protruding from the one surface of the window glass.

According to various embodiments, the antenna device may further include an artificial magnetic conductor or another mesh grid formed on the another surface of the window glass between the shark antenna and the window glass. The artificial magnetic conductor or the another mesh grid may suppress a surface current according to the operation of the shark antenna.

According to various embodiments of the present disclosure, since a radiation element may be configured by forming a mesh grid using a transparent conductive material, the antenna device may be easily concealed, and even if the antenna device is attached to, for example, a window glass of a vehicle or a window of a building, it may still be sufficiently visible. Accordingly, when the antenna device is installed, for example, in a built-up area, a vehicle, or a building, a shadow region can be removed and a radio wave environment can be improved. Furthermore, when a part of the mesh grid is utilized as a heating element, it is possible to remove frost or moisture formed on, for example, a window glass of a vehicle due to the difference between indoor and outdoor temperatures or a surrounding environment.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
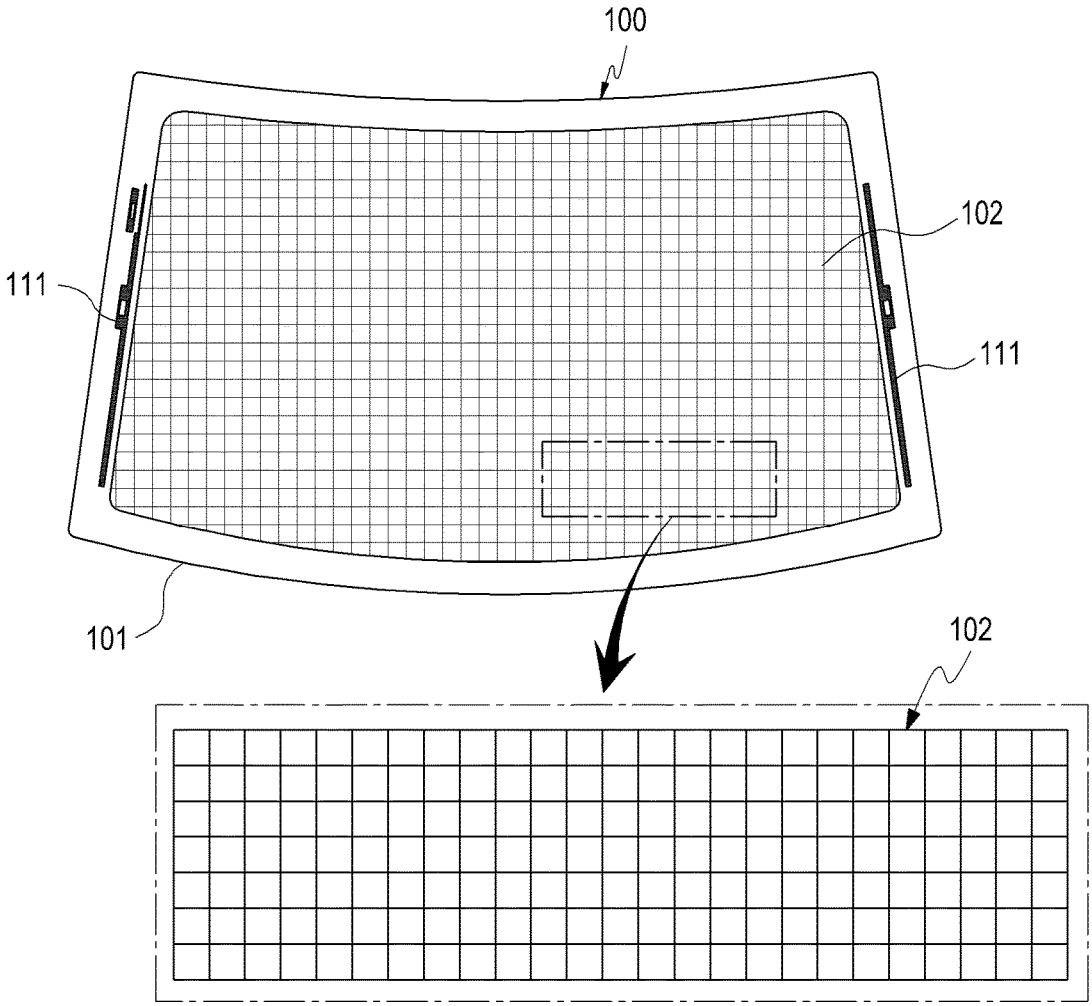
FIG. 1 is a view illustrating a mesh grid for configuring an antenna device according to various embodiment of the present disclosure.

The present disclosure may be variously modified and may have various embodiments, some of which will be described in more detail with reference to the accompanying drawings. However, it should be understood that the present disclosure is not limited to the specific embodiments, but the present disclosure includes all modifications, equivalents, and alternatives within the spirit and the scope of the present disclosure.

Although ordinal terms such as "first" and "second" may be used to describe various elements, these elements are not limited by the terms. The terms are used merely for the purpose to distinguish an element from the other elements. For example, a first element could be termed a second element, and similarly, a second element could be also termed a first element without departing from the scope of the present disclosure. As used herein, the term "and/or" includes any and all combinations of one or more associated items.

Further, the relative terms "a front surface", "a rear surface", "a top surface", "a bottom surface", and the like which are described with respect to the orientation in the drawings may be replaced by ordinal numbers such as first and second. In the use of ordinal numbers such as first and second, their order are determined in the mentioned order or arbitrarily, and may be arbitrarily changed if necessary.

The terms used in this application are for the purpose of describing particular embodiments only and are not intended to limit the disclosure. As used herein, the singular forms are intended to include the plural forms as well, unless the context clearly indicates otherwise. In the description, it should be understood that the terms "include" or "have" indicate existence of a feature, a number, a step, an operation, a structural element, parts, or a combination thereof, and do not previously exclude the existences or probability of addition of one or more another features, numeral, steps, operations, structural elements, parts, or combinations thereof.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present specification.

FIG. 1 is a view illustrating a mesh grid 102 for configuring an antenna device 100 according to various embodiments of the present disclosure.

According to various embodiments of the present disclosure, antenna device 100 may include a mesh grid 102 formed on a base substrate 101, in which at least a part of the mesh grid 102 may be utilized as a radiation element 103. The base substrate 101 formed of a dielectric material provides a surface for forming the mesh grid 102 thereon, and may form a glass, such as a building window or a vehicle window glass. While a configuration, in which the base substrate 101 is made of glass, is exemplified in describing specific embodiments of the present disclosure, the present disclosure is not limited thereto. For example, according to various embodiments, the antenna device 100 may include a base substrate made of a dielectric material, such as FR-4, so as to provide a plane for forming the mesh grid 102.

The mesh grid 102 may be formed of transparent electrodes, such as conducting wires formed by depositing a transparent conductive material on at least one surface of the base substrate 101, or within the base substrate 101. The transparent conductive material may be, for example, an Ag Nano-Wire (AgNW), Ag nano-particles, a metal mesh, an Indium-Tin Oxide (ITO), graphene, or a Carbon Nano Tube (CNT). The mesh grid 102 may be formed by arranging conducting wires that form transparent electrodes so as to cross one another at about 300 micrometers (μm) intervals. When, for example, deposition techniques are developed in the future, the conducting wires forming the mesh grid 102 may be arranged otherwise (e.g., more densely). When an exemplary mesh grid 102 is formed by arranging the conducting wires at the above-mentioned intervals, the mesh grid 102 may function as a conductor equivalent or equal to a plane conductor, particularly, when, for example, a power feeding signal or DC power is applied thereto. For example, a current may flow through the conducting wires that form the mesh grid 102, and since the intervals of the conducting wires are compact, the mesh grid 102 may function as a plane conductor for an electric signal applied thereto. Accordingly, the mesh grid 102 may at least partially form a radiation element 103 of an antenna device 100 or a heating element 121. For example, when a power feeding signal is applied, a part of the mesh grid 102 may serve as a radiation element 103, and when a DC power is applied, a part of the mesh grid 102 may serve as a heating element 121. According to various embodiments, the part forming the radiation element 103 and the part forming the heating element 121 may be superimposed one on another on the mesh grid 102.

When at least a part of the mesh grid 102 forms the heating element 121, the mesh grid 102 may remove frost or moisture formed on the base substrate 101. For example, when the base substrate 101 is formed by a vehicle window glass, the mesh grid 102 may replace an ordinary hot wire formed in a window glass. Due to a different between indoor and outdoor temperatures, frost or moisture may be formed on the inner surface (or the outer surface) of a vehicle window glass or a building window. When frost or moisture is formed on a window glass while a vehicle is running, the light transmissivity (visibility) of the window glass may be degraded and may threaten the safety of a passenger. Accordingly, heated air may be supplied toward the window glass or hot wires may be arranged on the window glass so as to remove the frost or moisture. The ordinary hot wires arranged on the ordinary vehicle window glass may be arranged at about 6 cm intervals in order to secure visibility, and the heating temperature may be limited to be lower than about 40° C. in order to prevent overheating. Accordingly, the complete removal of frost or moisture between adjacent hot wires arranged at regular intervals may take some time.

According to various embodiment of the present disclosure, when the vehicle window glass is utilized as the base substrate 101 and DC power is applied to the mesh grid 102 so as to make the mesh grid 102 function as a heating element 121, the frost or moisture formed on the vehicle window glass may be easily removed. In forming the hot wires on the vehicle window glass, a light transmissivity of about 84% or more may be required in order to secure visibility. Accordingly, hot wires on existing vehicle window glass may be arranged at about 6 cm intervals. When the mesh grid 102 replaces the hot wires, the heating element 121 may quickly remove frost or moisture from at least one entire surface of the base substrate 101, such as the vehicle window glass. This is enabled since the conducting wires that form the mesh grid 102 are densely formed at intervals of hundreds of micrometers. Furthermore, when the mesh grid 102 is either formed on or within the vehicle window glass using conducting wires arranged at about 300 micrometer intervals, it is possible to secure a light transmissivity of at least 88% and thus, the mesh grid 102 may be easily applied to the vehicle window glass. DC power ports 113 for applying DC power may be arranged in order to utilize the mesh grid 102 as a heating element 121. The DC power ports 113 may be arranged in opposite sides 111 (e.g., at opposite edges) of the base substrate 101, for example, the vehicle window glass.

Hereinafter, examples of forming a heating element 121 using the mesh grid 102 will be described with reference to FIGS. 2 to 6.

Figure 2:
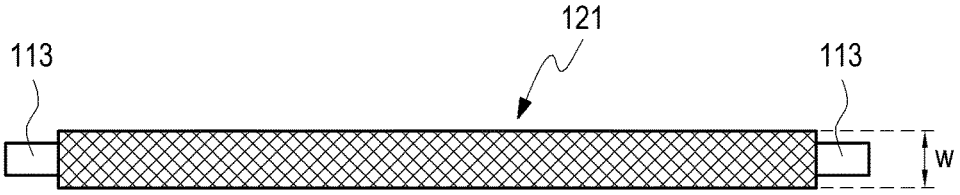
FIG. 2 is a view illustrating an example of forming a mesh grid for configuring an antenna device according to various embodiments of the present disclosure as a heating element.

FIG. 2 is a view illustrating an example of forming a mesh grid that constitutes an antenna device according to various embodiments of the present disclosure using a heating element 121.

In order to make the mesh grid 102 form a heating element 121, DC power should be applied thereto, and the flow of a current by the DC power may be evenly distributed over the entire base substrate 101. Referring to FIG. 2, in the case where the mesh grid 102 is constituted with the heating element 121, DC power ports 113 may be provided at the opposite ends of a mesh bar 121, respectively. The mesh bar 121 may be formed by depositing a transparent conductive material on a region having a width "w" (e.g., about 0.24 mm) and a length corresponding to the length of the base substrate 101 on at least one surface of the base substrate 101. For example, the mesh bar 121 may be formed by forming conducting wires that are so thin so as not to be discriminated with naked eyes at intervals of hundreds of micrometers in a predetermined region on the base substrate 101. The mesh grid 102 may be formed by evenly arranging a plurality of mesh bars 121 as described above on at least one surface of the base substrates 101, or within the base substrates 101, and by applying DC power to the DC power ports 113, the mesh grid 102 formed on the base substrate 101, for example, each of the mesh bars 121, may be utilized as a heating element 121.

Various shapes and arrangements of the mesh bars 121 are exemplified in FIGS. 3 to 6. Although a mesh grid 102 is not directly illustrated in the drawings for the purpose of conciseness of drawings in describing the shapes and arrangements of the mesh bars 121, a plurality of mesh bars 121 are arranged on one surface of the base substrate 101, or within the base substrate 101, so that the mesh grid 102 can be formed on at least one entire surface of the base substrate, as described above. In addition, it is noted that the mesh bars 121 are also illustrated in a simplified form for the purpose of conciseness of drawings.

FIGS. 3 to 6 are views illustrating arrangements of mesh grids 102 constituted with heating elements 121 in the antenna device according to various embodiments of the present disclosure.

Figure 3:
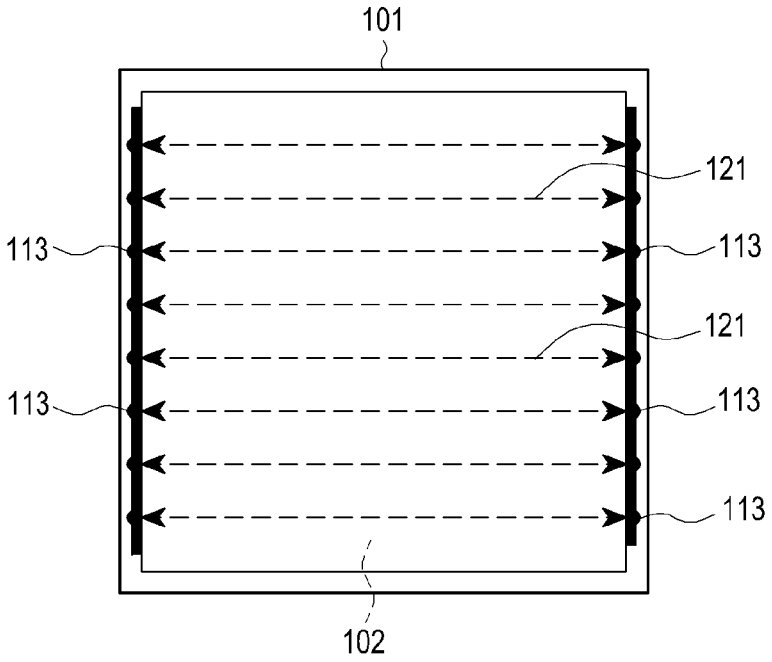
FIGS. 3 to 6 are views illustrating arrays of mesh grids constituted with heating elements in an antenna device according to various embodiments of the present disclosure.

Referring to FIG. 3, the mesh bars 121 may be disposed in a horizontal direction on the base substrate 101, and the DC power ports 113 may be disposed in opposite sides of the base substrate 101, respectively. The plurality of mesh bars 121 may be arranged to be adjacent to each other in the vertical direction of the base substrate 101. In arranging the plurality of mesh bars 121, each two adjacent mesh bars 121 may be disposed at intervals (e.g., of about 12 micrometers (μm)). In the specific embodiments of the present disclosure, the intervals of the conducting wires or the mesh bars 121 that form the mesh grid 102 are specifically mentioned, but may be properly changed according to the technical need at the time of fabricating the mesh grid 102 or the mesh bars 121. As a result, the mesh bars 121 may be evenly arranged on the entire area of the base substrate 101 (e.g., a vehicle window glass) so as to form the mesh grid 102. In addition, since the mesh bars 121 are arranged at regular intervals with respect to each other, each of the mesh bars 121 may receive DC power applied thereto so as to form an independent flow path of a current. Each of the mesh bars 121 has an intrinsic electric resistance value, and may function as a heating element 121.

Figure 4:
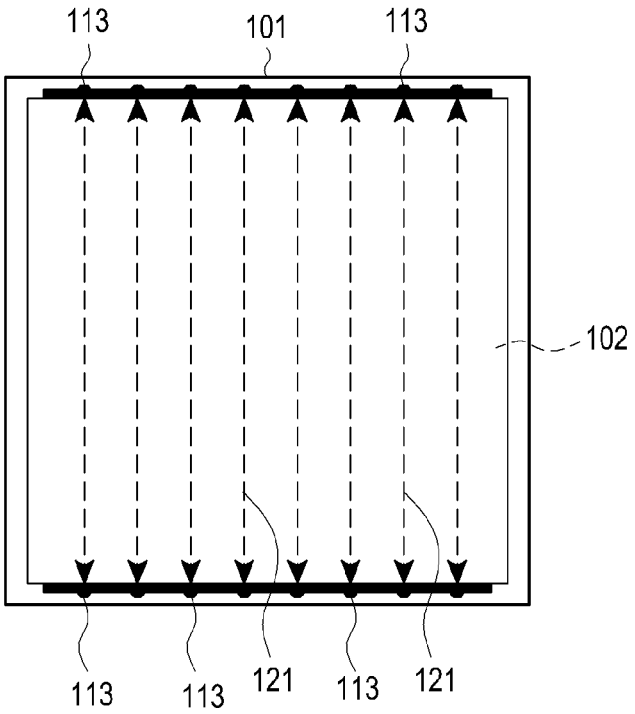
Figure 5:
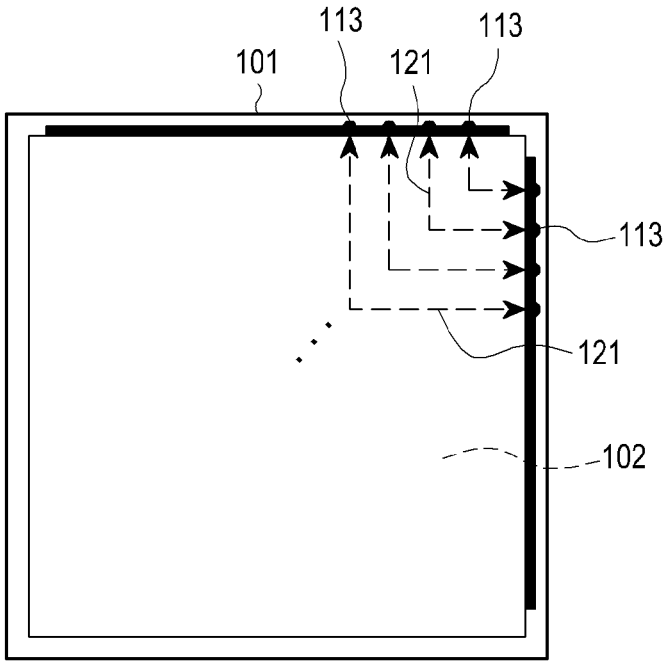
Figure 6:
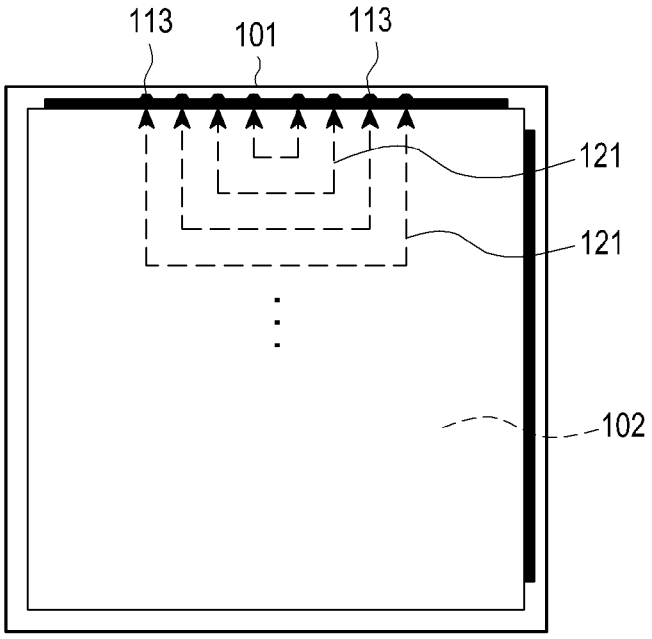

Referring to FIG. 4, the mesh bars 121 may be disposed in the vertical direction on the base substrate 101, or within the base substrate 101, the DC power ports 113 may be disposed in the upper and lower sides of the base substrates 101, respectively. The plurality of mesh bars 121 may be arranged to be adjacent to each other along the horizontal direction of the base substrate 101. Referring to FIGS. 5 and 6, each mesh bar 121 may have an "L" shape or a "U" shape, which is a different configuration than the preceding embodiments. For example, the mesh bars 121 may be fabricated in different shapes depending on, for example, the shapes, disposed structures, or heat generating conditions of the base substrate 101. For example, in a configuration of an antenna device 100 to be described later, when a part of the mesh grid 102 is formed as a radiation element 103, the shapes and arrangements of the mesh bars 121 may vary to match the radiation element 103.

As illustrated in FIGS. 3 to 6, the base substrate 101 may have a polygonal shape having at least four sides. According to various embodiments, the sides of the base substrate 101 do not necessarily have to be rectilinear, and according to the position where the base substrate 101 is placed or the installation environment of the antenna device 100, the sides of the base substrate may be formed in a curved shape. For example, when the base substrate 101 constitutes a vehicle window glass, each side of the base substrate 101 may be formed to match the frame shape of a vehicle which corresponds to the side. In disposing each of the mesh bars 121 on the base substrate 101, the DC power ports 113 may be individually disposed in at least one side of the base substrate 101, or within the base substrate 101. For example, as illustrated in FIG. 3 or FIG. 4, the DC power ports 113 may be disposed in two opposite sides. In addition, as illustrated in FIG. 5, the DC power ports 113 may be disposed in two adjacent sides, and as illustrated in FIG. 6, all the DC power ports 113 may be disposed in one side.

For example, when the mesh bars 121 are disposed on a vehicle window glass to be operated as heating elements 121, in terms of linear resistance, the mesh grid 102 may be configured to be in the range of about 0.5Ω to about 10Ω Exact figures vary from country to country, but a voltage of about 12 V or about 32 V and a current of about 10 A to about 30 A are applied to electronic devices installed in a vehicle, and a heat element for a window glass may be designed to have the power consumption of about 120 W to about 360 W. Accordingly, the linear resistance of the mesh bars 121 may be limited to be in a predetermined range so as to satisfy the above-mentioned conditions.

Figure 7:
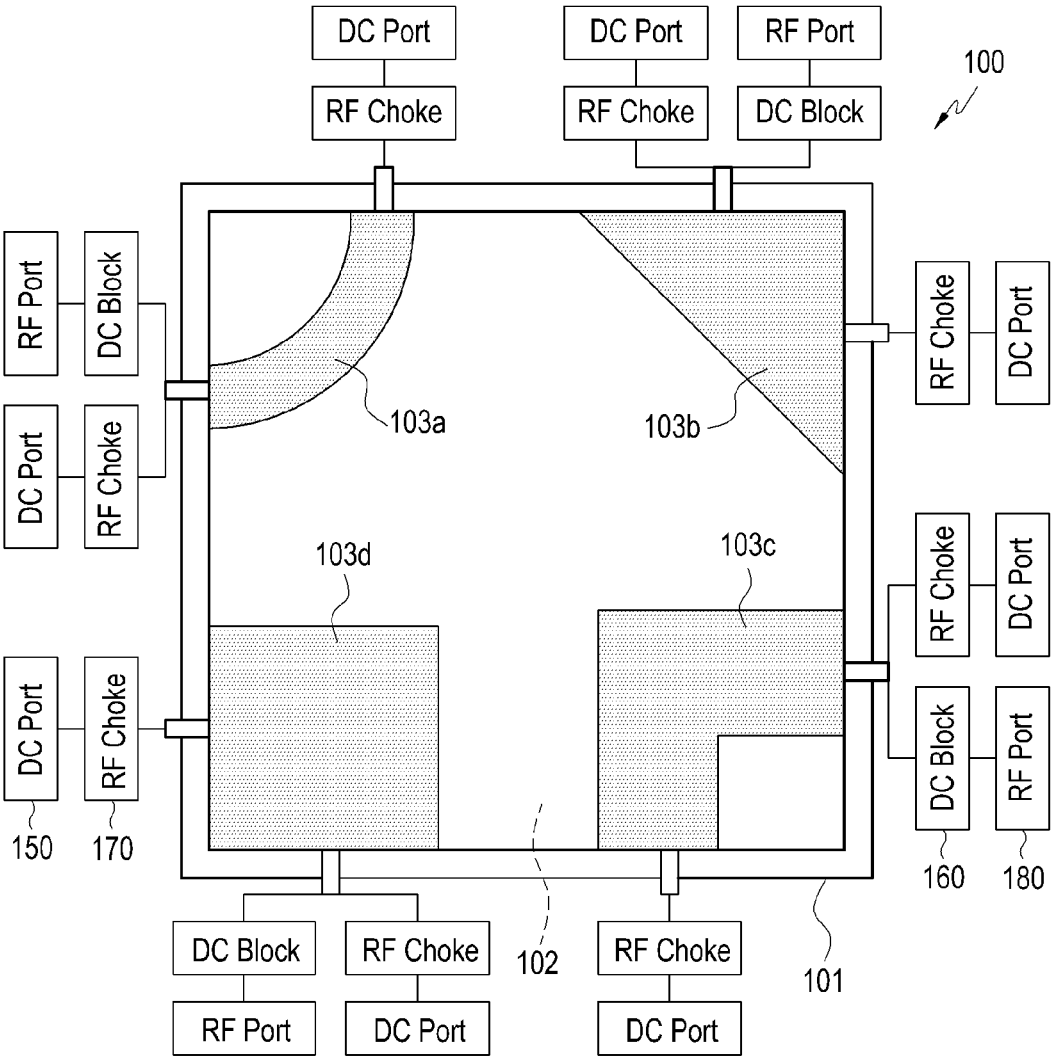
FIG. 7 is a view illustrating an antenna device according to one of various embodiments of the present disclosure.

For example, FIG. 7 illustrates an example in which a radiation element 103 and a heating element 121 are configured using the mesh grids 102 as described above.

Figure 8:
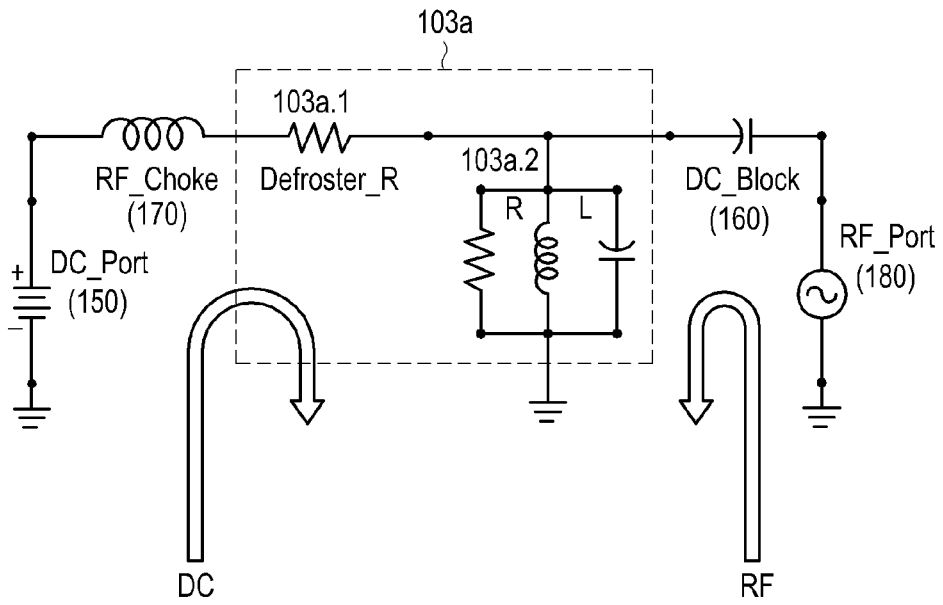
FIG. 8 is an equivalent circuit diagram of the antenna device illustrated in FIG. 7.

FIG. 7 is a view illustrating an antenna device 100 according to one of various embodiments of the present disclosure. FIG. 8 is an equivalent circuit diagram of the antenna device 100 illustrated in FIG. 7.

In FIG. 7, the mesh grids 102 or the mesh bars 121 are omitted and only some reference numerals are indicated for the conciseness of drawing. However, it is noted that the mesh grids 102 may be formed by arranging the above-described mesh bars 121 on at least one surface of the base substrate 101, or within the base substrate 101. Referring to FIG. 7, according to one of various embodiments of the present disclosure, in the antenna device 100, some of the mesh grids 102 formed on at least one surface of the base substrate 101 may be utilized as radiation elements 103*a*, 103*b*, 103*c*, and 103*d*. As discussed in the preceding embodiment, the mesh grid 102 may be formed by arranging a plurality of mesh bars 121, and at least some of the mesh bars 121 may function as heating elements 121. The DC power ports 150 (DC Port) for the mesh bars 121 (e.g., like the above-described DC power ports 113) functioning as the heating elements 121 may be arranged in different sides of the base substrate 101, respectively.

According to various embodiments, some of the mesh bars 121 functioning as the heating elements 121 may overlap with the radiation elements 103*a*, 103*b*, 103*c*, and 103*d*. For example, on the mesh grid 102, some or all of the radiation elements 103*a*, 103*b*, 103*c*, and 103*d* may be configured by the mesh bars 121 functioning as the heating elements 121. Each of the radiation elements 103*a*, 103*b*, 103*c*, and 103*d* is provided with a power feeding signal so as to enable the transmission/reception of a wireless signal through the antenna device 100. The antenna device 100 may include power feeding ports (e.g., Radio Frequency (RF) Port) that provide power feeding signals to the radiation elements 103*a*, 103*b*, 103*c*, and 103*d*, respectively. In the embodiment shown, the radiation element 103*a* includes a Defroster_R resistor 103*a*.1 and parallel RLC circuit or a resonant circuit 103*a*.2.

When at least a part of each of the radiation elements 103*a*, 103*b*, 103*c*, and 103*d* is also utilized as a heating element 121, the antenna device 100 may include a direct current (DC) power blocking unit 160 (e.g., DC Block) and a RF blocking unit 170 (e.g., RF Choke). Referring to FIG. 8, the DC power blocking units 160 (e.g., DC Block) may be provided between the power feeding ports 180 (e.g., RF Port) and the mesh grid 102, for example, the mesh bars 121 forming the radiation elements 103*a*, 103*b*, 103*c*, and 103*d* so as to prevent a direct current (DC) flowing in the radiation element 103*a*, 103*b*, 103*c*, and 103*d*, from being applied to the power feeding ports 180 (e.g., RF Port). The RF blocking units 170 (e.g., RF Choke) may be provided between the mesh bars 121 that function as the heating elements 121 while forming at least a part of the mesh grid 102, for example, the radiation elements 103*a*, 103*b*, 103*c*, and 103*d*, together with the DC power ports 150 (e.g., DC Port). For example, the RF blocking units 170 (e.g., RF Choke) may prevent the power feeding signals (RF signals) provided to the radiation elements 103*a*, 103*b*, 103*c*, and 103*d* from being input to the DC power ports 150 (e.g., DC Port).

Although not illustrated, the mesh bars 121, disposed in other regions which are not configured by radiation elements in the region formed by the mesh grid 102, may be applied with DC power to function as heating elements 121. For example, when the base substrate 101 is a vehicle window glass, the DC power may be applied to the mesh bars 121 forming the mesh grid 102 so as to evenly and quickly remove frost or moisture from the entire area of the base substrate 101. When it is not necessary to form the heating elements 121 on the base substrate 101, the DC power ports 150 (e.g., DC Port) may not be disposed on the mesh grids 102, for example, the mesh bars 121. For example, the antenna device 100 may include power feeding ports (e.g., RF Port) that provide power feeding signals to the radiation elements 103*a*, 103*b*, 103*c*, and 103*d*, and the above-mentioned DC power ports 150 (e.g., DC Port), DC power blocking units 160 (e.g., DC Block), and RF blocking units 170 (e.g., RF Choke) may not be disposed.

While the preceding embodiment has exemplified the "L" shape and "U" shape for the plurality of mesh bars 121 that are arranged to form the mesh grid 102, the mesh bars 121 may be formed in various other shapes. For example, as illustrated in FIG. 7, in consideration of a resonance characteristic of the radiation elements to be formed, a radiation element 103 having a shape indicated by reference numeral "103*a*" may be configured by arranging mesh bars 121 having a circular arc shape on concentric circles. In addition, while FIG. 7 exemplifies the radiation elements 103*a*, 103*b*, 103*c*, and 103*d* as a circular arc shape and a polygonal shape, the radiation elements 103*a*, 103*b*, 103*c*, and 103*d* may have, for example, a meander line shape or a loop shape.

As described above, according to various embodiments of the present disclosure, a part of the mesh grid 102 in the antenna device 100 may function as both a radiation element 103 and a heating element 121. According to another embodiment, a part of the mesh grid 102 may be configured as a radiation element 103, and a heating element 121 may be formed in a portion different from the radiation element 103. For example, the radiation elements 103 may be formed as a part of the mesh grid 102 in a portion independent from the heating element 121. According to still another embodiment, the antenna device 100 may include a plurality of radiation elements 103 formed independently from each other and formed as a part of the mesh grid 102 in a portion independent from the heating elements 121. When the radiation elements 103 and the heating elements 121 are formed independently from each other, or when the radiation elements 103 are independently formed each other in this way, it is possible to secure a stable radiation performance of the antenna device 100 by securing isolation.

Hereinafter, referring to FIGS. 9 to 15, descriptions will be made to configurations in which the radiation elements 103 and the heating elements 121 are formed independently from each other or the radiation elements 103 are formed independently from each other.

Figure 9:
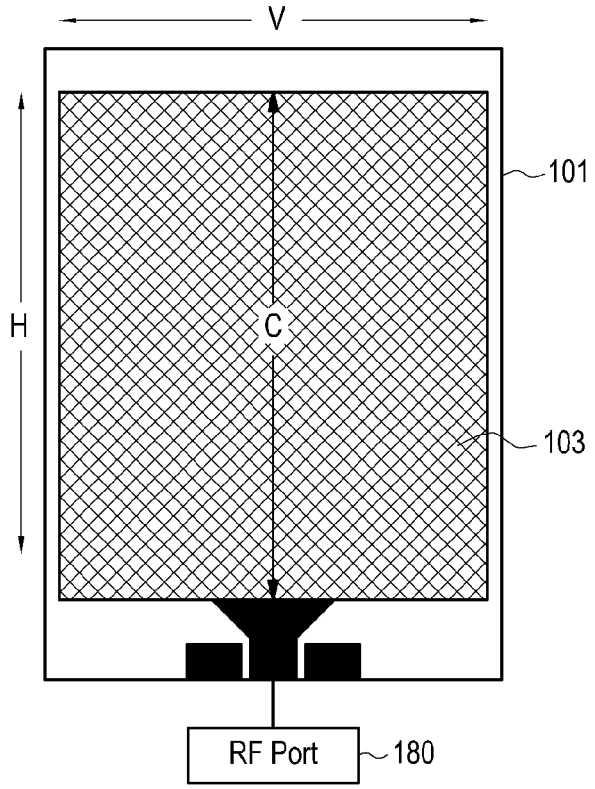
FIGS. 9 to 11 are views for describing examples of configuring a radiation element of an antenna device according to another one of various embodiments of the present disclosure.
Figure 10:
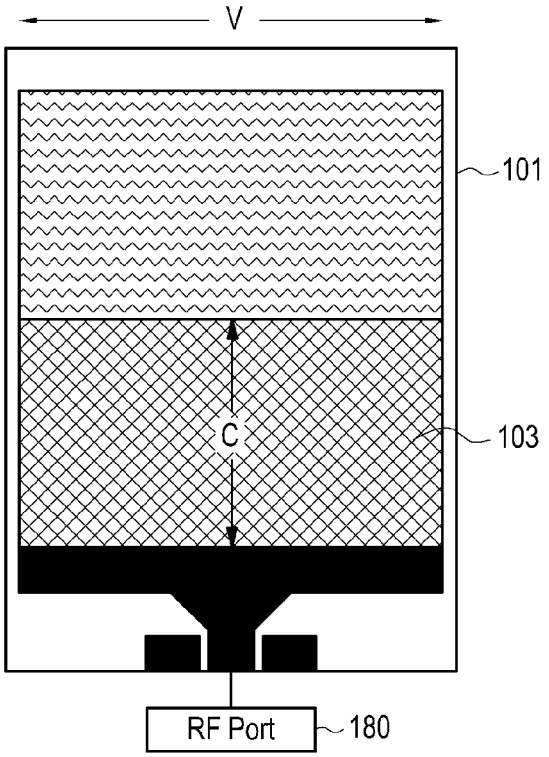
Figure 11:
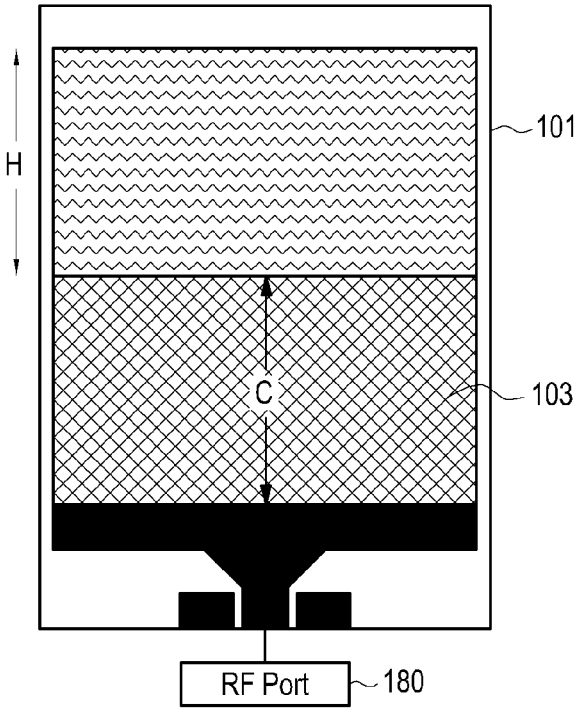

FIGS. 9 to 11 are views for describing examples of configuring a radiation element 103 of an antenna device 100 according to another one of various embodiments of the present disclosure.

Referring to FIG. 9, the radiation element 103 may be made of a mesh grid 102 formed on the base substrate 101. As described above, the mesh grid 102 may be formed by arranging transparent electrodes, for example, conducting wires formed by depositing a transparent conductive material, in a grid form. The conducting wires forming the mesh grid 102 may be arranged at intervals of hundreds of micrometers, and the radiation element 103 made of the mesh grid 102 may function as a radiation element similar to a plane conductor for a power feeding signal applied thereto.

Depending on the position of the power feeding port 180 (e.g., RF Port), the current flow on the radiation element 103, for example, the signal current flow "C" may be variously implemented. For example, when the power feeding port 180 (e.g., RF Port) is connected to the center of the lower end of the radiation element 103, the strongest signal current flow "C" may be formed in the vertical direction at the center of the radiation element 103. The resonance frequency of the radiation element 103 can be determined by the electric length of the radiation element 103 in the direction of the signal current flow "C."

FIGS. 10 and 11 illustrate examples in which segmental portions are formed on the mesh grid 102 in order to adjust the resonance frequency of the radiation element 103. Here, "segmental portion" may mean a section in which the conducting wires are disconnected from each other. In forming the segmental portions on the mesh grid 102, the segmental portions may be positioned on the path of the strongest signal current flow "C" on the mesh grid 102 that forms the radiation element 103.

Figure 12:
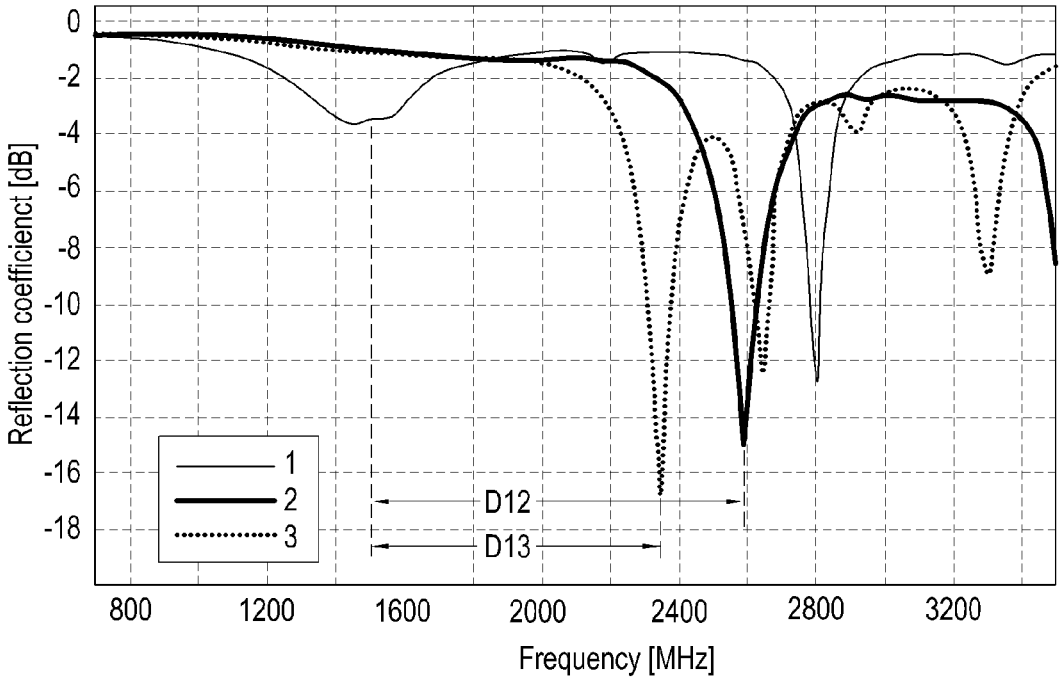
FIG. 12 illustrates a reflection coefficient measured for the radiation elements illustrated in FIGS. 9 to 11, respectively.
Figure 13:
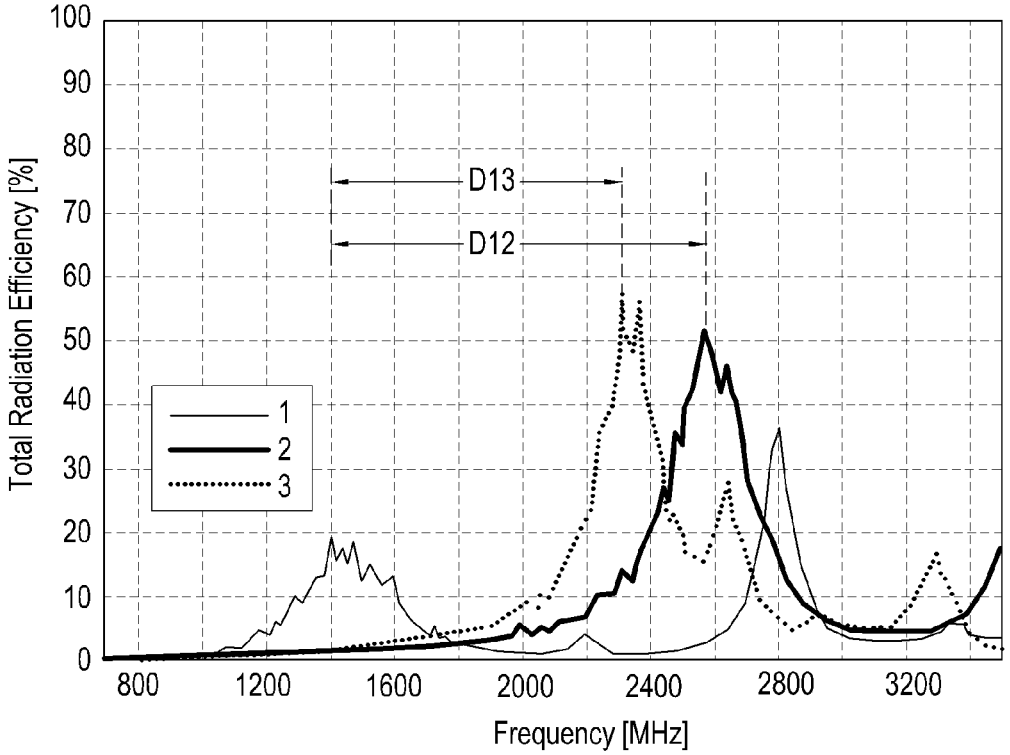
FIG. 13 illustrates a total radiation efficiency measured for the radiation elements illustrated in FIGS. 9 to 11, respectively.

Referring to FIG. 10, the resonance frequency of the radiation element 103 may be adjusted by forming a segmental portion extending along a vertical direction "V" with respect to the direction of the signal current flow "C" on the mesh grid 102. Referring to FIG. 11, the resonance frequency of the radiation element 103 may be adjusted by forming a segmental portion along a horizontal direction "H" with respect to the direction of the signal current flow "C" on the mesh grid 102. Upon comparing with the structure of the radiation element 103 illustrated in FIG. 9, the structures illustrated in FIGS. 10 and 11 may half the physical length of the radiation element 103 by forming the segmental portions. In addition, upon comparing the structures illustrated in FIGS. 10 and 11 with each other, it is possible to study ease of adjustment of a resonance frequency and securement of isolation by varying the directions of forming the segmental portions. FIGS. 12 and 13 illustrate changes in radiation characteristics according to the formation of segmental portions while configuring a radiation element 103 by forming a mesh grid 102 in a predetermined region.

FIG. 12 illustrates a reflection coefficient measured for the radiation elements 103 illustrated in FIGS. 9 to 11, respectively. FIG. 13 illustrates a total radiation efficiency measured for the radiation elements 103 illustrated in FIGS. 9 to 11, respectively.

Referring to FIGS. 12 and 13, the graphs designated by "1" represent the radiation characteristics of the radiation element 103 illustrated in FIG. 9, the graphs designated by "2" represent the radiation characteristics of the radiation element 103 illustrated in FIG. 10, and the graphs designated by "3" represent the radiation characteristics of the radiation element 103 illustrated in FIG. 11.

Upon being compared with the structure illustrated in FIG. 9, it can be seen that the resonance frequency shows a change D12 of about 1.2 GHz when the segmental portions are formed in the vertical direction "V" with respect to the direction of the signal current flow "C" on the path of the signal current flow "C" (e.g., the structure illustrated in FIG. 10), as illustrated in FIGS. 12 and 13. Also, it can be seen that the resonance frequency shows a change D13 of about 0.9 GHz when the segmental portions are formed in the horizontal direction "H" with respect to the direction of the signal current flow "C" on the path of the signal current flow "C" (e.g., the structure illustrated in FIG. 11), as illustrated in FIGS. 12 and 13. For example, the structure in which the segmental portions are formed in the horizontal direction "H" with respect to the direction of the signal current flow "C" (e.g., the structure illustrated in FIG. 11), shows a relatively smaller change in resonance frequency as well as relatively lower isolation as compared to the structure in which the segmental portions are formed in the vertical direction "V" (e.g., the structure illustrated in FIG. 10). This has been ascertained as a phenomenon occurring as the signal power of power feeding signals is more easily induced with the mesh grids 102 alternately arranged with the segmental portions in the structure in which the segmental portions are formed in the horizontal direction "H" with respect to the direction of the signal current flow "C" than in the structure in which the segmental portions in the vertical direction "V" with respect to the direction of the signal current flow "C."

In view of this measurement result, it is possible to secure good isolation between a radiation element 103 and mesh grids 102 (e.g., mesh grids 102 only functioning as heating elements 121) around the radiation element 103 by forming the segmental portions in the vertical direction with respect to the direction of the signal current flow on the path of the strongest signal current flowing in the radiation element 103. In addition, the resonance frequency required for the radiation element 103 can be easily secured through the segmental portion formation structure.

While the shapes of radiation elements 103 using a mesh grid 102 and current flow directions have been described in a simplified manner in the specific embodiments of the present disclosure, the present disclosure is not limited thereto. For example, the radiation elements 103 may be designed in different shapes in consideration of, for example, a resonance frequency, directivity, and radiation power of an antenna device 100 to be manufactured. When the radiation elements 103 are designed to have different shapes, the flow directions of a signal current flowing in the radiation elements 103 may also become different, and thus, the forming directions or arrangements of the segmental portions may also become different.

For example, when it is necessary to secure isolation between two adjacent radiation elements 103, the structures in which the segmental portions are formed may become different depending on the positional relationship of the radiation elements 103. For example, the direction where a signal power is induced between the two radiation elements 103 may be different from the flowing direction of the signal current formed in each radiation element 103. The segmental portions may be formed on the mesh grid 102 in consideration of these points. For example, regardless of the flowing direction of the signal current in each of the radiation elements 103, the segmental portions extending in the vertical direction with respect to the direction in which the signal power is induced between the two radiation elements 103 may be formed so as to secure isolation between the two adjacent radiation elements 103. According to various embodiments, when the segmental portions extend to be aligned along the edges of the radiation element 103 (e.g., to be parallel), it is possible to secure isolation with respect to other radiation elements 103 or heating elements 121.

Figure 14:
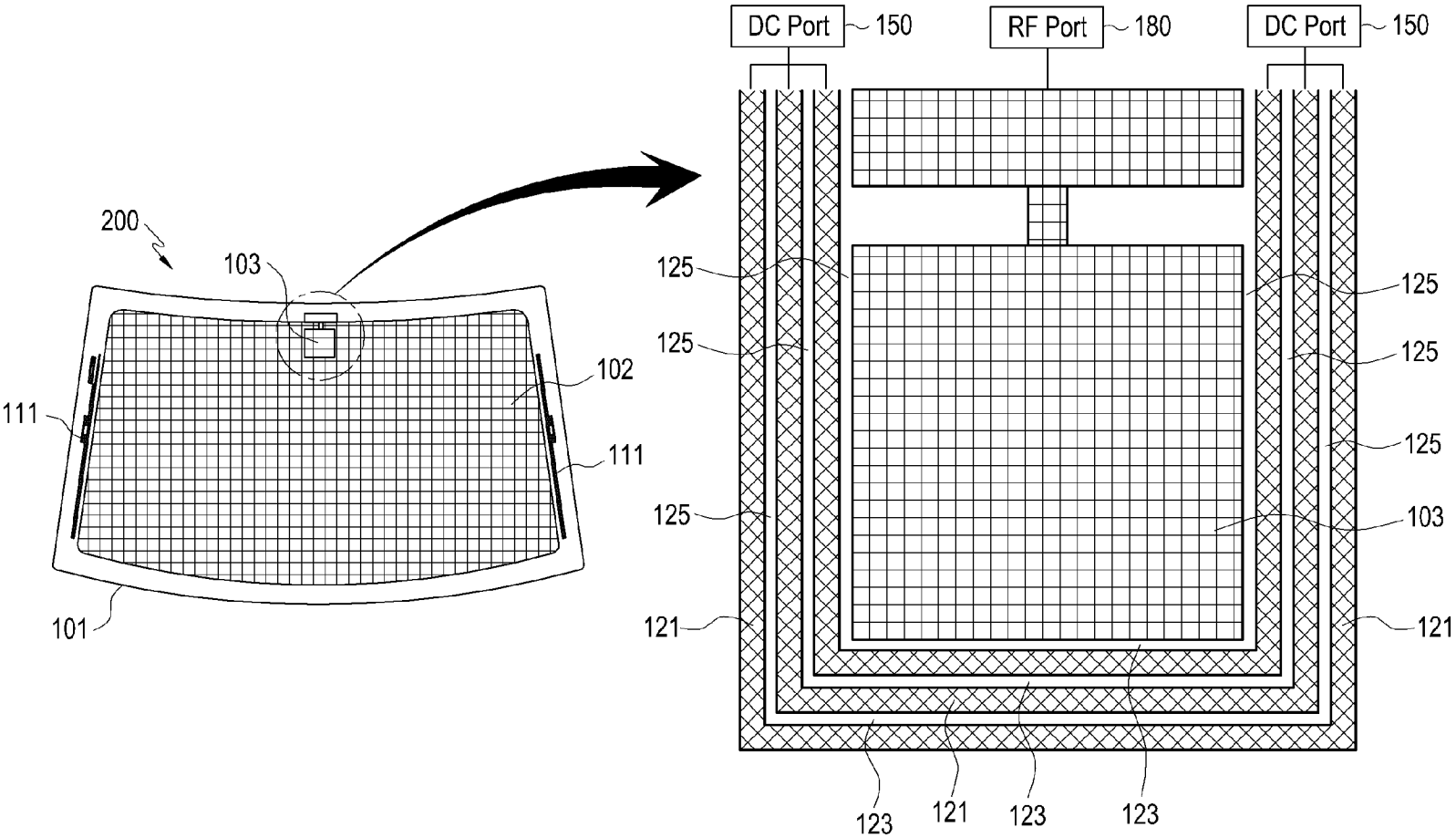
FIG. 14 is a view illustrating an antenna device according to another one of various embodiments of the present disclosure.

FIG. 14 exemplifies an example of implementing a radiation element 103 independent from another portion (for example, the mesh bars or heating elements 121) on a mesh grid 102.

FIG. 14 is a view illustrating an antenna device 200 according to another one of various embodiments of the present disclosure.

Referring to FIG. 14, according to another one of various embodiments of the present disclosure, the antenna device 200 may include a mesh grid 102 formed on a base substrate 101, and a plurality of segmental portions 123 and 125 may be formed on the mesh grid 102. The shape of the radiation element 103 of the antenna device 200 may be set by the segmental portions 123 and 125. The radiation element 103 may be formed by a portion of the mesh grid 102 formed on the base substrate 101 or by a mesh grid 102 formed on a separate film.

Among the segmental portions 123 and 125, the first segmental portions 123 may extend in the vertical direction with respect to the flow direction of the power feeding signal formed when the power feeding signal is applied to the radiation element 103 through a power feeding port 180 (e.g., RF Port). The first segmental portions 123 may be formed by cutting the connection of the transparent electrodes forming the mesh grid 102. Among the segmental portions 123 and 125, the second segmental portions 125 may extend in the horizontal direction with respect to the flow direction of the power feeding signal formed in the radiation element 103. The second segmental portions 125 may be formed by cutting the connection of the transparent electrodes or conducting wires forming the mesh grid 102. Each of the second segmental portions 125 may be connected to any one of both ends of the first segmental portions 123.

According to various embodiments, the first segmental portions 123 may be disposed on the flow path of the signal current formed in the radiation element 103, and the second segmental portions 125 may be disposed at both sides of the flow path of the signal current. For example, the radiation element 103 may be disposed within a region surrounded by the first and second segmental portions 123 and 125. According to various embodiments, the mesh grid 102 remaining between each two adjacent first segmental portions 123 or between each two adjacent second segmental portions 125, may be utilized as, for example, the above-described mesh bar 121. According to the arrangement of the first and second segmental portions 123 and 125, a mesh bar 121 extending along the path formed in a "U" shape may be formed around the radiation element 103. By providing a DC power port 150 (e.g., DC Port) to each of both ends of the mesh bar 121 to apply DC power, the mesh bar 121 may function as a heating element. The configuration of the heating element 121 may be easily understood through the above-described embodiments. In addition, the radiation element 103 may secure sufficient isolation with respect to the mesh bars 121 by the structure of the first and second segmental portions 123 and 125.

Figure 15:
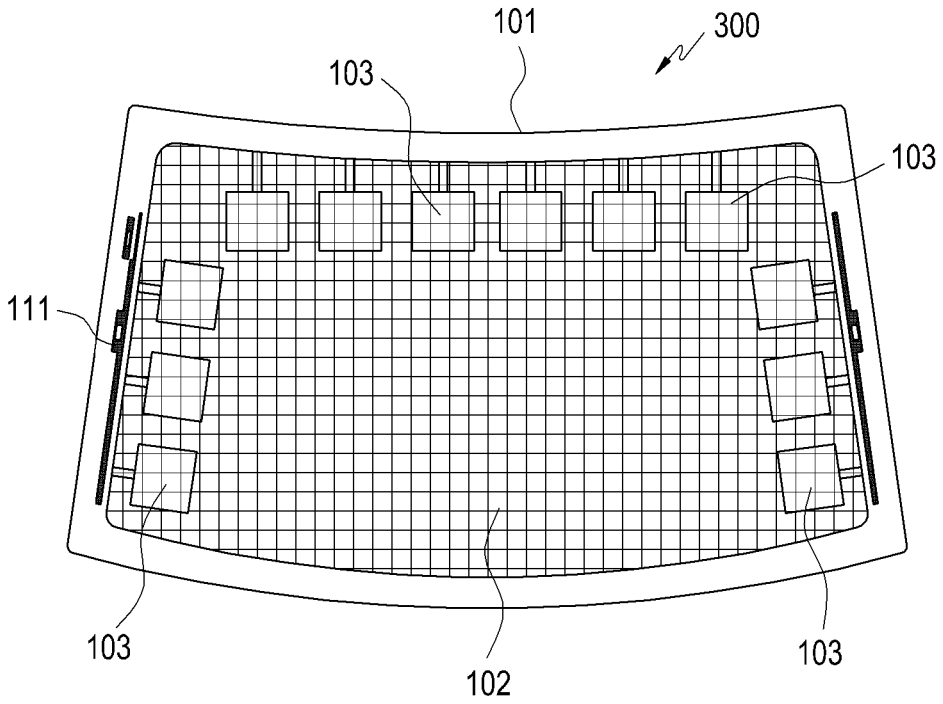
FIG. 15 is a view illustrating an antenna device according to still another one of various embodiments of the present disclosure.
Figure 16:
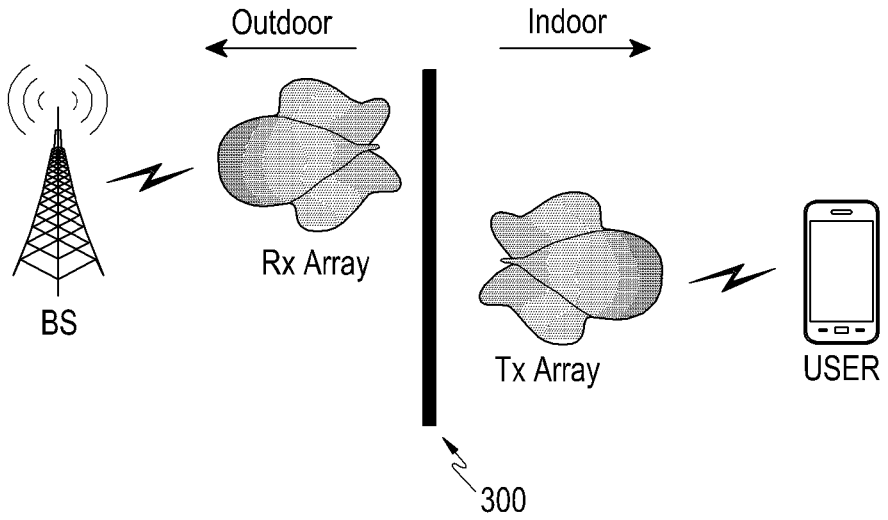
FIG. 16 is a view for describing a utilization example of the antenna device according to various embodiments of the present disclosure.

An extended configuration of the above-mentioned antenna device and a utilization example thereof are exemplified in FIGS. 15 and 16.

FIG. 15 is a view illustrating an antenna device 300 according to still another one of various embodiments of the present disclosure.

Referring to FIG. 15, the antenna device 300 may include a plurality of radiation elements 103 arranged along the edges of a base substrate 101, for example, a vehicle window glass. The radiation elements 103 may be set to function at the same frequency band or at different frequency bands, respectively. Some of the radiation elements 103 may provide a reception function, and the others may provide a transmission function. In addition, the radiation elements 103 may provide a repeater function that radiates a wireless signal incident on one surface of the base substrate 101 to the other surface of the base substrate 101. While the embodiment exemplifies a configuration in which the radiation elements 103 are arranged along the edges of the base substrate 101, the number and arrangement of the radiation elements 103 may be variously implemented. According to various embodiments, the radiation elements 103 of the antenna device 300 may be implemented as the radiation elements 103 that have the structure described above with reference to FIG. 14.

FIG. 16 is a view for describing a utilization example of the antenna device according to various embodiments of the present disclosure.

Referring to FIG. 16, according to various embodiments of the present disclosure, an antenna device 300 may receive wireless signals incident thereon from an outdoor space and may radiate the wireless signals to an indoor space. Here, the "outdoor space" may mean a region in which the radio wave environment is excellent, for example, the outside of a vehicle or a building, and the "indoor space" may mean a region where the radio wave environment is poor, for example, the inside of a vehicle or a building. The base substrate of the antenna device 300 may be implemented by a window glass or a window of a building. As described above, the above-mentioned radiation elements 103 may provide a repeater function by themselves. The radiation elements 103 may receive signals sent from an outdoor base station (BS) and incident on the radiation elements 103 and radiate the signals to the indoor space. According to various embodiments, as illustrated in FIG. 16, the antenna device 300 may include a plurality of radiation elements 103, some of which may configure an arrangement of providing a reception function (Rx Array) and the other radiation elements 103 may configure an arrangement of providing a transmission function (Tx Array). For example, some of the radiation elements 103 that configure the antenna device 300 may receive wireless signal incident thereon outdoors and the other radiation elements 103 may radiate the incident wireless signals indoors.

In an environment in which an obstacle exists on a progressing path of wireless signals, such as a built-area or the inside of a building, a shadow region where radio waves having a high rectilinearly advancing property cannot arrive may be formed. In addition, within a vehicle, a local shadow region may be formed due to the vehicle body having a shielding tendency in relation to the radio waves, even though the interior of the vehicle is constricted. Such shadow regions may be removed by the antenna devices according to various embodiments of the present disclosure. For example, by installing the antenna device 300 to a window of a building and a window glass of a vehicle at a position where the radio wave environment is good, the shadow regions may be removed.

The above-described embodiment exemplifies a configuration that receives radio waves incident thereon outdoors and radiates the radio waves indoors. According to various embodiments of the present disclosure, however, the antenna device 300 may receive radio waves incident thereon outdoors and may transmit the radio waves to other directions in an outdoor space according to setting of the radiation elements 103 in the antenna device 300. For example, an outdoor shadow region formed in a built-up area may be removed by disposing the antenna device 300 as described above on a window of a building at a position where the radio wave environment is good.

Figure 17:
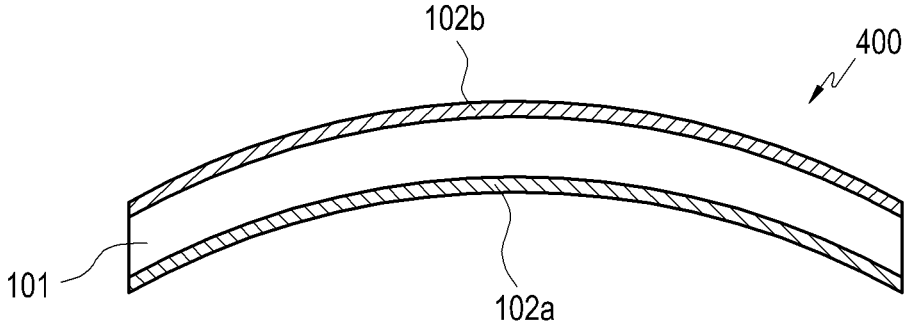
FIG. 17 is a view illustrating an antenna device according to still another one of various embodiments of the present disclosure.

FIG. 17 is a view illustrating an antenna device 400 according to still another one of various embodiments of the present disclosure.

The antenna device 400 may include mesh grids 102*a* and 102*b* formed on both surfaces of the base substrate 101, respectively. Each of the mesh grids 102*a* and 102*b* may be implemented as a radiation element 103 or a heating element 121 as described above. According to various embodiments, a part of the mesh grid 102*b* formed on the top surface of the base substrate 101 may be formed as the radiation element 103, and the mesh grid 102*a* formed on the bottom surface of the base substrate 101 may be set as a heating element 121 as described above or as a ground that provides a reference potential. When the radiation element 103 and the heating element 121 are formed on the different surfaces of the base substrate 101 (e.g., a vehicle window glass), the power feeding ports or the DC power ports described above may be disposed on the different surfaces of the base substrate 101, respectively. A configuration, in which a ground is provided by the mesh grid 102*b* on one surface of the base substrate 101 and the radiation element 103 is formed by the mesh grid 102*a* on the other surface, may implement the characteristics of a patch antenna having directivity.

Figure 18:
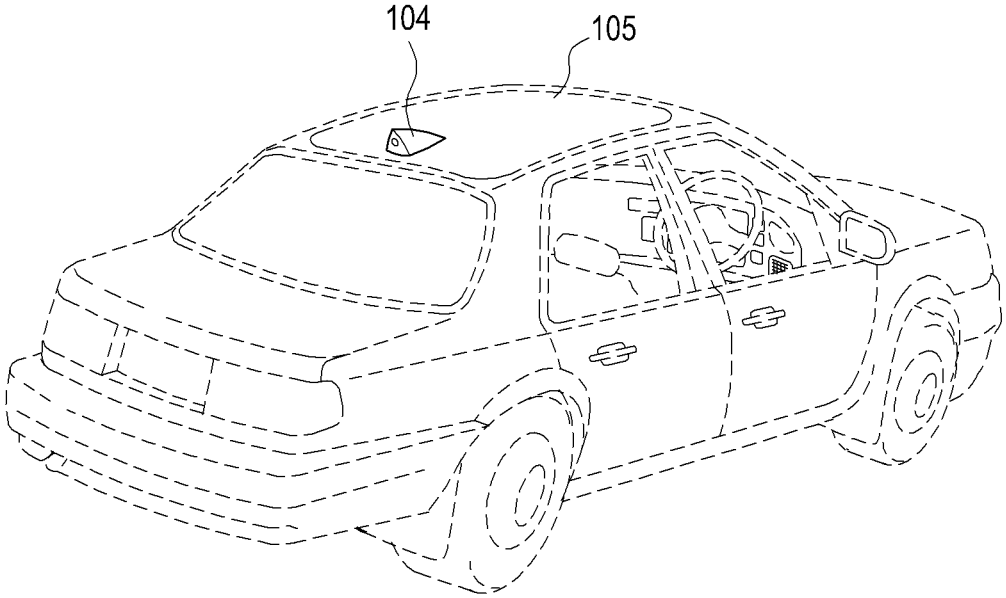
FIG. 18 is a view for describing a configuration installed in a vehicle by applying the antenna device according to various embodiments of the present disclosure.
Figure 19:
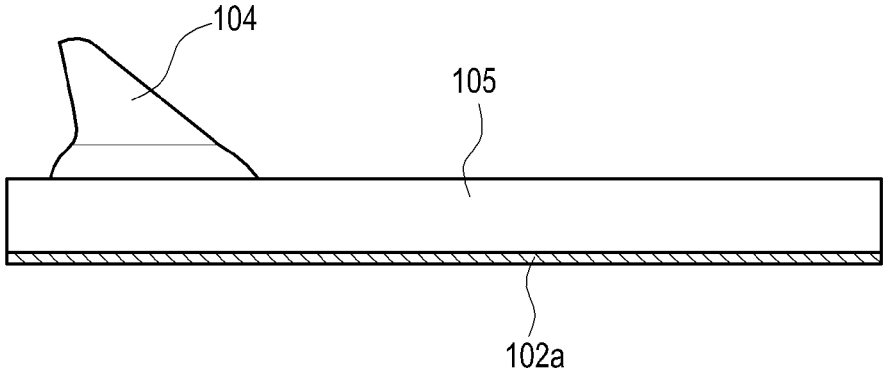
FIGS. 19 and 20 are views illustrating application examples of the antenna device according to various embodiments of the present disclosure, respectively.
Figure 20:
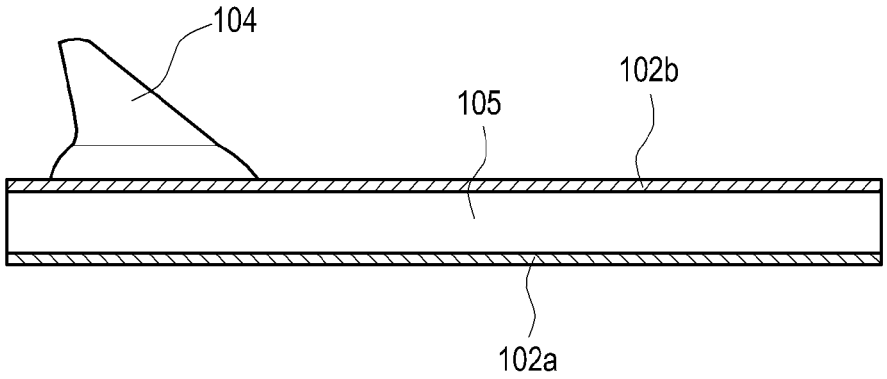

FIG. 18 is a view for describing a configuration installed in a vehicle by applying the antenna device according to various embodiments of the present disclosure. FIGS. 19 and 20 are views illustrating application examples of the antenna device according to various embodiments of the present disclosure, respectively.

In general, an antenna 104 for receiving terrestrial radio broadcasting may be mounted on a vehicle. Recently, other antennas have been mounted on the vehicle for receiving Global Positioning System (GPS) for navigation, receiving traffic information, or service link connection of a vehicle manufacturer, for example. As the position or space for installing the antennas is restricted depending on the body structure of the vehicle, a radiation element 103 protruding to the outside of the vehicle, for example, a shark antenna 104 equipped with a plurality of antennas, such as a patch antenna, may be installed as illustrated in FIG. 18. The shark antenna 104 may be replaced by, for example, a radiation element 103 as described above.

Meanwhile, vehicles configured to enable opening/closing of a roof so as to secure openness by mounting a sunroof made of a tempered glass gradually increase. While the early sunroofs were openable only partially, a panorama sunroof 105, in which the entire roof is made of a tempered glass except for an edge frame, has appeared. As the panorama sunroof 105 is mounted, the space for installing an antenna 104 (e.g., a shark antenna 104) in the vehicle is unavoidably restricted. This is because a metal vehicle body portion capable of providing a ground for securing the directivity of an antenna 104 is narrowed in the roof of the vehicle. On the other hand, because it is necessary to secure an antenna ground in order to install the above-described shark antenna 104, the area, in which a panorama sunroof 105 is installed, may be restricted. For example, when the panorama sunroof 105 and the shark antenna 104 are installed in unison, the performance of the antenna 104 may be deteriorated or a mismatch may occur in the external appearance of the entire roof.

By applying the antenna device 104 according to various embodiments of the present disclosure, it is possible to install the shark antenna to be capable of performing a functional performance stably while installing the panorama sunroof 105 over the entire roof of a vehicle, except for the edges of the roof. Referring to FIGS. 19 and 20, in the case where the roof of the vehicle is formed of a dielectric material (e.g., glass) rather than a metal, a reference potential may be provided by forming the above-mentioned mesh grid 102*a* on one surface of the roof as the above-mentioned base substrate 101. For example, by disposing the above-mentioned mesh grid 102*a* on the inner surface, within the inner surface one surface (e.g., the inner surface) of the panorama sunroof and the shark antenna 104 on, or within the other surface (e.g., the outer surface) of the panorama sunroof 105, the mesh grid 102*a* may form a ground that provides the reference potential to the shark antenna 104. When a surface current is induced on, for example, the panorama sunroof 105 according to the operation of the antennas incorporated in the shark antenna 104, an additional mesh grid 102 or an Artificial Magnetic Conductor (AMC) 102*b* may be formed in order to suppress the surface current from being induced.

While specific embodiments have been described herein, it will be evident to a person ordinarily skilled in the art that various changes can be made without departing from the scope of the present disclosure. For example, in the various embodiments described above, while it has been merely described that a radiation element 103 is provided with a power feeding signal, the power feeding signal may be provided in a direct power feeding manner in which the radiation element 103 is directly connected to a power feeding port, or in an indirect power feeding manner by a capacitive or inductive coupling. In addition, even in a case where a shark antenna is provided with a reference potential by forming a mesh grid 102 on a panorama sunroof 105, on which the shark antenna 104 is installed, a part of the mesh grid 102 may include the radiation elements 103, 103*a*, 103*b*, 103*c*, and 103*d* according to one of the various embodiments described above. In addition, the radiation element 103 of the antenna device according to various embodiments of the present disclosure may be variously utilized, for example, in a commercial mobile communication network, a long-range wireless communication including, for example, satellite communication or GPS, a short-range wireless communication including, for example, wireless LAN, Wi-Fi, or Bluetooth, and a near field wireless communication for, for example, an contactless-type ID identification device or wireless charge.

What is claimed is:

1. An antenna device comprising:

a base substrate;

a mesh grid formed by transparent electrodes on at least one surface of the base substrate;

a power feeding port connected to the mesh grid to provide a power feeding signal;

first segmental portions formed by cutting connection of the transparent electrodes along a vertical direction with respect to a flow direction of the power feeding signal provided through the power feeding port; and second segmental portions formed by cutting connection of the transparent electrodes along a horizontal direction with respect to a flow direction of the power feeding signal provided through the power feeding port, wherein at least a part of the mesh grid forms a radiation element with at least one of the power feeding signal indicative of direct feeding, or the power feeding signal indicative of coupled feeding indirectly, and wherein the radiation element is formed in a region surrounded by the first segmental portions and the second segmental portions.

2. The antenna device of claim 1, further comprising:

a direct current (DC) power port that applies a DC power to the mesh grid, wherein at least a part of the mesh grid forms a heating element by receiving the DC power applied thereto.

3. The antenna device of claim 2, wherein the radiation element and the heating element at least partially overlap each other on the mesh grid.

4. The antenna device of claim 3, further comprising:

a direct current (DC) power blocking unit disposed between the power feeding port and the mesh grid; and a radio frequency (RF) blocking unit disposed between the DC power port and the mesh grid.

5. The antenna device of claim 2, wherein the mesh grid receiving the DC power applied thereto forms the heating element having a resistance value in a range of 0.5Ω to 10Ω.

6. The antenna device of claim 1, further comprising:

a DC power port applying the DC power to the mesh grid between the first segmental portions or between the second segmental portions, wherein the mesh grid between the first segmental portions or between the second segmental portions form the heating element by receiving the DC power applied thereto.

7. The antenna device of claim 1, wherein the base substrate includes glass.

8. The antenna device of claim 7, wherein the mesh grid is formed on at least one surface of the base substrate, the power feeding port provides the power feeding signal to the mesh grid on at least one surface of the base substrate, and the antenna device further comprises a DC power port that applies the DC power to the mesh grid formed on another surface of the base substrate.

9. The antenna device of claim 8, wherein the base substrate has a polygonal shape having at least four sides, and one pair of DC power ports are disposed in at least one side of the base substrate.

10. The antenna device of claim 8, wherein the mesh grid receiving the DC power applied thereto forms the heating element having a resistance value in a range of 0.5Ω to 10Ω.

11. The antenna device of claim 7, further comprising:

a patch antenna provided on at least one surface of the base substrate, wherein the mesh grid forms a ground of the patch antenna by providing a reference potential.

12. The antenna device of claim 7, wherein the antenna device comprises a plurality of the radiation elements that are arranged along a side of the base substrate, and at least one of the plurality of the radiation elements provides a reception function, and at least one of the radiation elements provides a transmission function.

13. An antenna device comprising:

a mesh grid formed on at least one surface of a vehicle window glass formed of a transparent conductive material;

a power feeding port connected to the mesh grid so as to provide a power feeding signal;

a DC power port that applies a DC power to the mesh grid;

first segmental portions formed by cutting connection of the transparent electrodes along a vertical direction with respect to a flow direction of the power feeding signal provided through the power feeding port; and second segmental portions formed by cutting connection of the transparent electrodes along a horizontal direction with respect to a flow direction of the power feeding signal provided through the power feeding port, wherein at least a part of the mesh grid forms a radiation element by being provided with the power feeding signal, and at least a part of the mesh grid forms a heating element by receiving the DC power applied thereto, and wherein the radiation element is formed in a region surrounded by the first segmental portions and the second segmental portions.

14. The antenna device of claim 13, wherein the part of the mesh grid, which forms the radiation element, and the part of the mesh grid, which forms the heating element, overlap each other.

15. The antenna device of claim 14, further comprising:

a direct current (DC) power blocking unit disposed between the power feeding port and the mesh grid; and a radio frequency (RF) blocking unit disposed between the DC power port and the mesh grid.

16. The antenna device of claim 13, further comprising:

a DC power port applying the DC power to the mesh grid between the first segmental portions or between the second segmental portions, wherein the mesh grid between the first segmental portions or between the second segmental portions forms the heating element by receiving the DC power applied thereto.

17. The antenna device of claim 13, wherein the antenna device comprises a plurality of the radiation elements that are arranged along a side of the window glass, and at least one of the plurality of the radiation elements provide a reception function, and at least one of the radiation elements provide a transmission function.

18. An antenna device comprising:

a mesh grid formed from a transparent conductive material on at least one surface of a vehicle window glass;

a radiation element mounted on another surface of the window glass; and at least one of an artificial magnetic conductor or another mesh grid formed on the another surface of the window glass between the radiation element and the window glass, wherein the artificial magnetic conductor or the another mesh grid suppresses a surface current according to the operation of the shark antenna, wherein the mesh grid forms a ground providing a reference potential to the radiation element.

19. The antenna device of claim 18, wherein the radiation element includes a shark antenna protruding from the another surface of the window glass.

20. The antenna device of claim 18, wherein at least a part of the mesh grid forms a radiation element with at least one of the power feeding signal indicative of direct feeding, or the power feeding signal indicative of coupled feeding indirectly.

* * * * *